US011510496B1

(12) United States Patent
Zhang

(10) Patent No.: US 11,510,496 B1
(45) Date of Patent: Nov. 29, 2022

(54) ARMREST PAD ASSEMBLY AND CHAIR ARMREST

(71) Applicant: Comfort Office Furniture Co., Ltd Guangdong, Guangzhou (CN)

(72) Inventor: Min Zhang, Guangzhou (CN)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 0 days.

(21) Appl. No.: 17/540,454

(22) Filed: Dec. 2, 2021

(30) Foreign Application Priority Data

May 25, 2021 (CN) ..... 202121135655.1

(51) Int. Cl.
*A47C 7/54* (2006.01)

(52) U.S. Cl.
CPC ..... *A47C 7/541* (2018.08)

(58) Field of Classification Search
CPC ..... A47C 1/03; A47C 1/0308; A47C 7/54; A47C 7/541
USPC ..... 297/411.35, 411.44
See application file for complete search history.

(56) References Cited

U.S. PATENT DOCUMENTS 6,343,839 B1 2/2002 Simons, Jr.
7,644,991 B2 * 1/2010 Davis ..... A47C 7/543 297/411.36

FOREIGN PATENT DOCUMENTS

CH 680640 A * 10/1992 ..... A47C 1/03
DE 202008010035 U1 11/2008
GB 2045070 A * 10/1980 ..... A47C 7/546

OTHER PUBLICATIONS

European search report and European search opinion dated Jun. 14, 2022; EP 21216779.5.

* cited by examiner

*Primary Examiner* — Sarah B McPartlin
(74) *Attorney, Agent, or Firm* — IPro, PLLC

(57) ABSTRACT

An armrest pad assembly includes: an armrest pad, wherein the armrest pad includes a first support section, a bendable section, and a second support section that are successively connected along a lengthwise direction of the armrest pad; wherein the armrest pad is internally provided with a first inner frame and a second inner frame, the first inner frame being fixed to the first support section, and the second inner frame being fixed to the second support section; wherein the first inner frame and the second inner frame are configured to be connected to an armrest frame of a chair, such that during upward and downward folding adjustment of the armrest frame of the chair, the first inner frame and the second inner frame drive the first support section and the second support section to be folded upward and downward about the bendable section to a predetermined position.

18 Claims, 5 Drawing Sheets

ARMREST PAD ASSEMBLY AND CHAIR ARMREST

CROSS REFERENCE TO RELATED APPLICATIONS

The present disclosure claims priority to Chinese Patent Application No. 202121135655.1, filed with the Chinese Patent Office on May 25, 2021, titled "ARMREST PAD ASSEMBLY AND CHAIR ARMREST", the entire contents of which are incorporated herein by reference.

TECHNICAL FIELD

Embodiments of the present disclosure relate to the technical field of chairs, and in particular, relate to an armrest pad assembly and a chair armrest.

BACKGROUND

A chair is typically equipped with armrests for supporting arms of a user, such that comfort of the user during seating is improved. Conventional chair armrests may be categorized into fixed armrests and movable armrests. In the movable armrest, the position of the armrest relative to the chair may be adjusted.

At present, the fixed armrest and the movable armrests both have only one support plane, and thus the forearm and elbow of the user in a scenario where the user has to bend the elbow when using a mobile phone or the like fail to be effectively supported, which causing fatigue of the arm.

SUMMARY

Accordingly, embodiments of the present disclosure provide an armrest pad assembly and a chair armrest, such that the forearm and elbow of a user when the user bending the elbow are supported in sections.

According to one aspect of the embodiments of the present disclosure, an armrest pad assembly is provided. The armrest pad assembly includes: an armrest pad made of a flexible material, wherein the armrest pad includes a first support section, a bendable section, and a second support section that are successively connected along a lengthwise direction of the armrest pad; wherein the armrest pad is internally provided with a first inner frame and a second inner frame, the first inner frame being fixed to the first support section, and the second inner frame being fixed to the second support section; wherein the first inner frame and the second inner frame are configured to be connected to an armrest frame of a chair, such that during upward and downward folding adjustment of the armrest frame of the chair, the first inner frame and the second inner frame drive the first support section and the second support section to be folded upward and downward about the bendable section to a predetermined position.

In an optional embodiment, the bendable section is provided with a recess, wherein the recess is extended to an edge of the armrest pad along a widthwise direction of the armrest pad.

In an optional embodiment, a plurality of recesses are provided, wherein the plurality of recesses are spaced apart along the lengthwise direction of the armrest pad.

In an optional embodiment, the recess is linear or curved.

In an optional embodiment, the recess includes a first curved slot, a second curved slot, and a linear slot disposed between the first curved slot and the second curved slot; wherein along the widthwise direction of the armrest pad, a distance between the first curved slot and the second curved slot progressively increases and then progressively decreases from a middle position to two ends, a spacing between the first curved slot and the second curved slot at the middle position is minimum, and the linear slot is not contiguous at the middle position.

In an optional embodiment, an accommodation chamber is disposed at a bottom of the armrest pad, wherein the recess is disposed in an inner surface, in the accommodation chamber, of the bendable section and/or disposed in an outer surface, facing away from the accommodation chamber, of the bendable section; and the first inner frame and the second inner frame are disposed in the accommodation chamber.

In an optional embodiment, the first inner frame is disposed corresponding to the first support section in the armrest pad, and the first inner frame is a support frame of the first support section; wherein the second inner frame is disposed corresponding to the second support section in the armrest pad, and the second inner frame is a support frame of the second support section.

In an optional embodiment, a thickness of the bendable section is less than or equal to a thickness of the first support section, and the thickness of the bendable section is less than or equal to a thickness of the second support section.

According to another aspect of the embodiments of the present disclosure, a chair armrest is provided. The chair armrest includes: an armrest frame and the armrest pad assembly as described above. The armrest frame includes a first support arm, a second support arm, and a rotation locking mechanism connected between the first support arm and the second support arm, the first support arm being fixed to the first inner frame, and the second support arm being fixed to the second inner frame; wherein the rotation locking mechanism is configured to automatically lock the first support arm and the second support arm in the case that the first support section and the second support section are relatively folded about the bendable section to a predetermined position.

In an optional embodiment, the rotation locking mechanism includes a guide assembly, and a fixing wheel, a slider and an elastic member that are mounted on the guide assembly; wherein one end of the guide assembly is fixed to the first support arm, the fixing wheel is rotatably connected to the other end of the guide assembly and fixed to the second support arm, the fixing wheel is provided with a plurality of fixing teeth disposed along a circumferential direction, the slider is provided with latching teeth in mesh with the fixing teeth, the slider is disposed between the fixing wheel and the elastic member, and the elastic member is abutted against a side, facing away from the fixing wheel, of the slider and is in a compressed state; a guide groove is disposed at a position, between the fixing wheel and the elastic member, of the guide assembly, wherein the slider is partially slidably disposed in the guide groove, and the guide groove is provided with a first end and a second end; and the fixing wheel, in response to rotating upward and downward relative to the guide assembly, drives the slider to slide back and forth between the first end and the second end, and the slider and the fixing wheel are meshed and in a one-way locked state in the case that the slider slides to the first end, and the slider and the fixing wheel are in an unlocked state in the case that the slider slides to the second end.

In an optional embodiment, the guide groove is an arc-shaped groove, wherein a distance from the arc-shaped groove to a center of the fixing wheel progressively increases from the first end to the second end, and/or a width of the guide groove along a radial direction progressively increases from the first end to the second end.

In an optional embodiment, the rotation locking mechanism further includes a restoration torsion spring, wherein the restoration torsion spring is disposed on the guide assembly, one end of the restoration torsion spring is fixed to the first support arm and the other end of the restoration torsion spring is fixed to the second support arm, and the restoration torsion spring is configured to supply a return force for restoration of the first support arm and the second support arm.

In an optional embodiment, the guide assembly includes a fixing base, and a first guide plate and a second guide plate that are symmetrically disposed on both sides of the fixing base; wherein the fixing base is fixedly connected to the first support arm; wherein a moving space is formed between the first guide plate and the second guide plate; wherein one end of each of the first guide plate and the second guide plate is fixed to the fixing base, and the other end of each of the first guide plate and the second guide plate is provided with a first through hole and a second through hole that are coaxially disposed.

In an optional embodiment, the fixing wheel is disposed in the accommodating space and is provided with a first convex shaft and a second convex shaft at both ends along the axial direction, and the first convex shaft and the second convex shaft are in a clearance fit.

In an optional embodiment, the guide groove includes a first guide groove and a second guide groove, wherein the first guide groove is disposed on the first guide plate and is positioned on a side, proximal to the fixing base, of the first through hole; wherein the second guide groove is disposed on the second guide plate and is positioned on a side, proximal to the fixing base, of the second through hole; wherein the slider is positioned in the moving space, and both ends of the slider are respectively and movably disposed in the first guide groove and the second guide groove; wherein one end of the elastic member is fixed to the fixing base, and the other end of the elastic member is positioned in the moving space and abutted against a side, facing away from the fixing wheel, of the slider.

In an optional embodiment, a middle position of the fixing wheel is also provided with a fixing hole allowing both ends of the fixing wheel to penetrate, the fixing shaft has a prismatic structure, and the fixing hole is a prismatic hole adapted to the prismatic structure, such that the fixing wheel does not rotate relative to the fixing shaft after being sleeved on the fixing shaft.

In an optional embodiment, a side of the fixing base is provided with an abutting arm, wherein the abutting arm is of a cylindrical structure; wherein one end of the fixing shaft is provided with a bayonet; wherein the restoration torsion spring is sleeved on the end of the fixing shaft provided with the bayonet; wherein one end of the restoration torsion spring is clamped with the bayonet, and the other end of the restoration torsion spring is abutted against the abutting arm of the fixing base.

In an optional embodiment, the rotation locking mechanism further includes a first support and a second support; wherein one end of each of the first support and the second support is fixed to the second support arm; wherein the other end of each of the first support and the second support is fixed to both ends of the fixing shaft, and at least one of the first support and the second support is detachably connected to the fixing shaft; wherein the fixing wheel is sleeved on a middle position of the fixing shaft.

In an optional embodiment, the rotation locking mechanism further includes two washers; wherein one of the two washers is sleeved on the first convex shaft and is disposed between the first support and the first guide plate; wherein the other of the two washers is sleeved on the second convex shaft and is positioned between the second support and the second guide plate.

According to another aspect of the embodiments of the present disclosure, a chair is provided. The chair includes the chair armrest as described above.

During use of the armrest pad assembly according to the embodiments, in the case that the armrest frame of the chair and the support arm connected to the first inner frame are folded upward and downward relative to the support arm connected to the second inner frame, the first support section is driven, by the first inner frame and the second inner frame, to be folded upward and downward relative to the support arm about the bendable section, such that the first support section and the second support section of the armrest pad may be relatively folded. In this way, a single support plane of the armrest pad assembly is switched to two support surfaces that are inclined to each other in terms of space. With such configuration, in a scenario where the user needs to bend his or her elbow in using a mobile phone or reading a book, the armrest pad 10 is capable of supporting the forearm and elbow in sections, relieving fatigue, and improving user experience.

The above description only summarizes the technical solutions of the present disclosure. Specific embodiments of the present disclosure are described hereinafter to better and clearer understand the technical solutions of the present disclosure, to practice the technical solutions based on the disclosure of the specification and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

Figure 1:
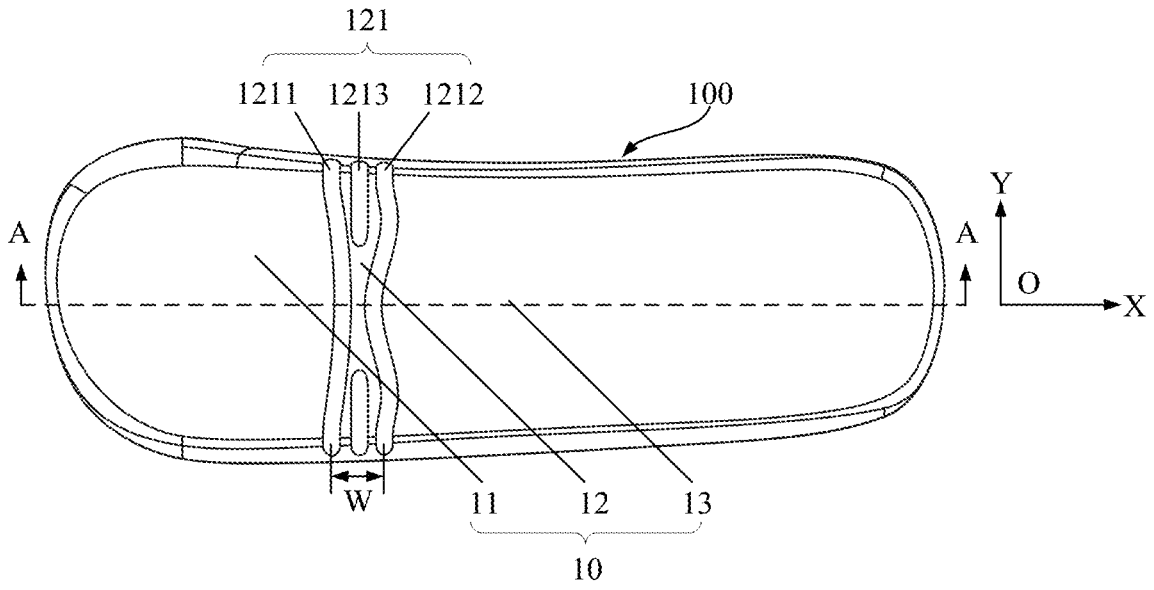
FIG. 1 illustrates a top view of an armrest pad assembly according to an embodiment of the present disclosure.

Reference numerals in the embodiments and denotations thereof:

10—armrest pad assembly, 11—first support arm, 12—bendable section, 121—recess, 1211—first curved slot, 1212—second curved slot, 1213—linear slot, 13—second support section, 14—first inner frame, 15—second inner frame, and 16—accommodation chamber;

20—first support arm;

30—second support arm;

40—rotation locking mechanism, 41—guide assembly, 410—guide groove, 410*a*—first guide groove, 410*b*—second guide groove, 4101—first end, 4102—second end, 411—fixing base, 4111—abutting arm, 412—first guide plate, 4121—first through hole, 413—second guide plate, 4131—second through hole, 42—fixing wheel, 421—fixing teeth, 422—first convex shaft, 423—second convex shaft, 424—fixing hole, 43—slider, 431—latching teeth, 44—elastic member, 45— fixing shaft, 451—bayonet, 46—restoration torsion spring, 47—first support, 48—second support, and 49—washer;

100—armrest pad assembly;

200—armrest frame;

2—chair armrest; and

1—chair.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Figure 2:
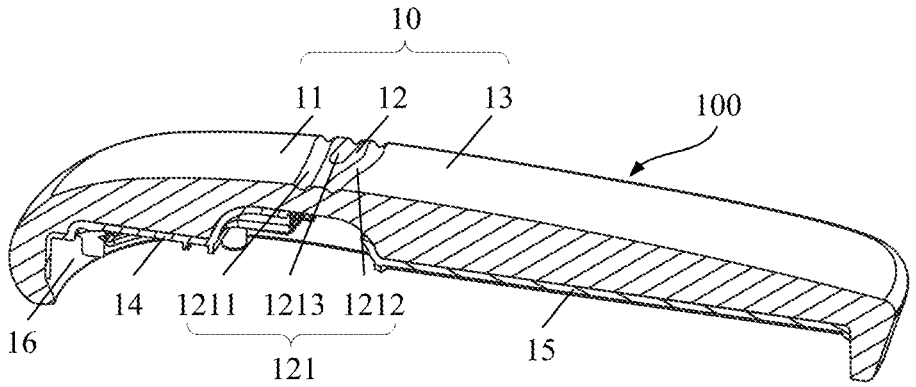
FIG. 2 illustrates a perspective cross-sectional view of FIG. 1 along an A-A direction according to an embodiment of the present disclosure.
Figure 3:
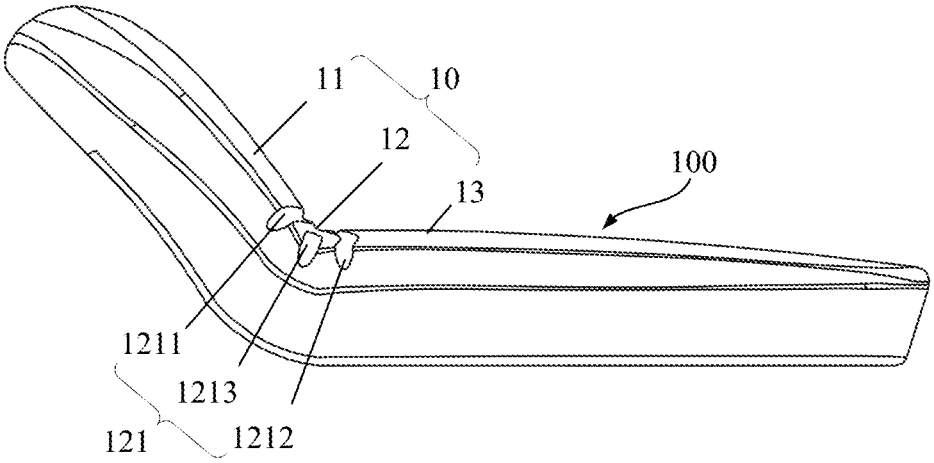
FIG. 3 illustrates a schematic structural view of an armrest pad assembly bent upward for use according to an embodiment of the present disclosure.

Referring to FIG. 1 to FIG. 3, FIG. 1 illustrates a top view of an armrest pad assembly according to an embodiment of the present disclosure, FIG. 2 illustrates a perspective cross-sectional view of FIG. 1 along an A-A direction according to an embodiment of the present disclosure, and FIG. 3 illustrates a schematic structural view of an armrest pad assembly bent upward for use according to an embodiment of the present disclosure.

An embodiment of the present disclosure provides an armrest pad assembly 100. The armrest pad assembly 100 includes an armrest pad 10 made of a flexible material. The armrest pad 10 includes a first support section 11, a bendable section 12, and a second support section 13 that are successively connected along a lengthwise direction (an X-axis direction in FIG. 1) of the armrest pad 10. The armrest pad 10 is internally provided with a first inner frame 14 and a second inner frame 15. The first inner frame 14 is fixed to the first support section 11, and the second inner frame 15 is fixed to the second support section 13. The first inner frame 14 and the second inner frame 15 are configured to be connected to a support arm corresponding to an armrest frame of a chair armrest, such that during upward and downward folding of the support arm of the armrest frame of the chair armrest, the first inner frame 14 and the second inner frame 15 drive the first support section 11 and the second support section 13 to be folded upward and downward about the bendable section 12 to a predetermined position.

The flexible material may be an elastic material such as silicone, rubber, or other elastic composite materials, which is not specifically limited herein. The first inner frame 14 and the second inner frame 15 may be made of, but not limited to, a hard material, such as hard plastic, or a metal.

The first inner frame 14 is disposed corresponding to the first support section 11 in the armrest pad 10, and the first inner frame 14 is a support frame of the first support section 11. The second inner frame 15 is disposed corresponding to the second support section 13 in the armrest pad 10, and the second inner frame 15 is a support frame of the second support section 13. The armrest pad 10 is made of a flexible material, such that the armrest pad 10 is entirely flexible. In the case that the first inner frame 14 is folded upward and downward relative to the second inner frame 15, the first support section 11 may be driven to be folded upward and downward about the bendable section 12 relative to the second support section 13. A position angle of the relative folding between the first support section 11 and the second support section 13 may be adjusted according to an elbow bending angle posture of a user's arm.

During use, in the case that the armrest frame of the chair armrest and the support arm connected to the first inner frame 14 are folded upward and downward relative to the support arm connected to the second inner frame 15, the first support section 11 is driven, by the first inner frame 14 and the second inner frame 15, to be folded upward and downward relative to the support arm 13 about the bendable section 12, such that the first support section 11 and the second support section 13 of the armrest pad 10 may be relatively folded. In this way, a single support plane is switched to two support surfaces that are inclined to each other in terms of space. With such configuration, in a scenario where the user needs to bend his or her elbow in using a mobile phone or reading a book, the armrest pad 10 is capable of supporting the forearm and elbow in sections, relieving fatigue, and improving user experience.

In some embodiments, a thickness of the bendable section 12 may be less than a thickness of the first support section 11 or the second support section 13, such that the flexibility of the bendable section 12 is greater than the flexibility of the first support section 11 or the second support section 13, and the bendability of the bendable section 12 is improved.

It is understandable that, in other embodiments, the thickness of the bendable section 12 may also be equal to the thickness of the first support section 11 or the second support section 13.

In some embodiments, the bendable section 12 is provided with a recess 121. The recess 121 is extended along a widthwise direction (a Y-axis direction in FIG. 1) of the armrest pad 10, and two ends of the recess 121 are extended to an edge of the armrest pad 10.

An extension direction of the recess 121 may be perpendicular to a central axis of the lengthwise direction of the armrest pad 10, or may be inclined at an angle with respect to the central axis of the lengthwise direction of the armrest pad 10.

In this embodiment, by configuring the recess 121 on the bendable section 12, a thickness of the area where the recess 121 is provided on the bendable section 12 is less than a thickness of the bendable section 12 in other areas, so as to improve the flexibility of the bendable section 12, such that the first support section 11 and the second support section 13 may be more easily folded relative to the bendable section 12.

In some embodiments, a plurality of recesses 121 are provided, wherein the plurality of recesses 121 are spaced apart along the lengthwise direction of the armrest pad 10.

In general, the size of the bendable section 12 is limited. In the case that only one recess 121 is provided on the bendable section 12, the size of the recess 121 occupies a larger space on the bendable section 12. This weakens an overall structural strength of the bendable section 12.

In this embodiment, by configuring the plurality of recesses 121 spaced apart along the lengthwise direction of the armrest pad 10 on the bendable section 12, a width of the single recess 121 along the lengthwise direction of the armrest pad 10 may be reduced, and the structural strength of the bendable section 12 is improved.

In some embodiments, the recesses 121 may be linear or curved. The recesses 121 may be in a curved shape such as, but not limited to, a sinusoidal wave shape or an arc shape.

In some embodiments, the recesses 121 include a first curved slot 1211, a second curved slot 1212, and a linear slot 1213 disposed between the first curved slot 1211 and the second curved slot 1212. Along the widthwise direction of the armrest pad 10, a distance w between the first curved slot 1211 and the second curved slot 1212 progressively increases and then progressively decreases from a middle position to two ends, a spacing between the first curved slot 1211 and the second curved slot 1212 at the middle position is minimum, and the linear slot 1213 is not contiguous at the middle position. With this structure, in the case that the first support section 11 is folded upward and downward about the bendable section 12 relative to the second support section 13, the risk of break of the bendable section 12 may be reduced.

It should be noted that the first curved slot 1211, the linear slot 1213, and the second curved slot 1212 are extended along the widthwise direction of the armrest pad 10, and the first curved slot 1211, the linear slot 1213, and the second curved slot 1212 are spaced apart along the lengthwise direction of the armrest pad 10 on the bendable section 12. The number of first curved slots 1211, the number of linear slots 1213, and the number of second curved slots 1212 may be independently set according to the actual situation, for example, one, two or more. However, the numbers are not specifically limited herein.

In some embodiments, an accommodation chamber 16 is disposed at a bottom of the armrest pad 10. The recesses 121 are disposed in an inner surface, in the accommodation chamber 16, of the bendable section 12 and/or disposed in an outer surface, facing away from the accommodation chamber 16, of the bendable section 12. The first inner frame 14 and the second inner frame 15 are disposed in the accommodation chamber 16.

As an example, the recesses 121 may only be disposed on an outer surface of a top of the bendable section 12. In this way, the recesses 121 may be directly machined on an outer surface of the armrest pad 10, and the operation is convenient.

Further, the recesses 121 may also be disposed on the inner surface, facing towards a side of the accommodation chamber 16. Specifically, the recess 121 may be disposed on the bottom surface of the bendable section 12. In this way, the recesses 121 are not exposed on the outer surface of the armrest pad 10, which is conducive to improving the consistency of appearance and beautifying the appearance.

Further, the recesses 121 may also be simultaneously disposed on the outer surface and an inner surface of the bendable section 12. That is, the recesses 121 are disposed on the bottom surface of the bendable section 12, and the recesses 121 are also disposed on the top surface outside the bendable section 12.

In this embodiment, by receiving both the first inner frame 14 and the second inner frame 15 in the accommodating chamber 16, the armrest pad 10 may protect the first inner frame 14 and the second inner frame 15, and the appearance of the chair armrest is simpler and cleaner.

It should be noted that the accommodating chamber 16 may also be configured to accommodate the armrest frame of the chair armrest.

Figure 4:
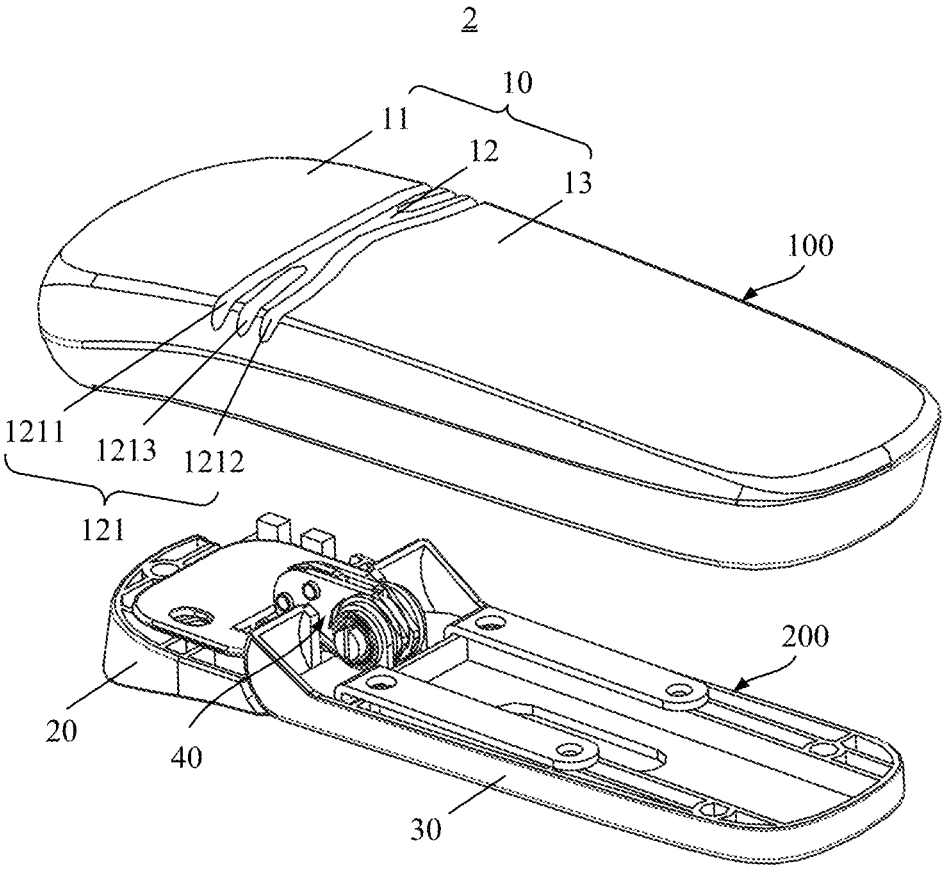
FIG. 4 illustrates an exploded view of a chair armrest according to an embodiment of the present disclosure.
Figure 5:
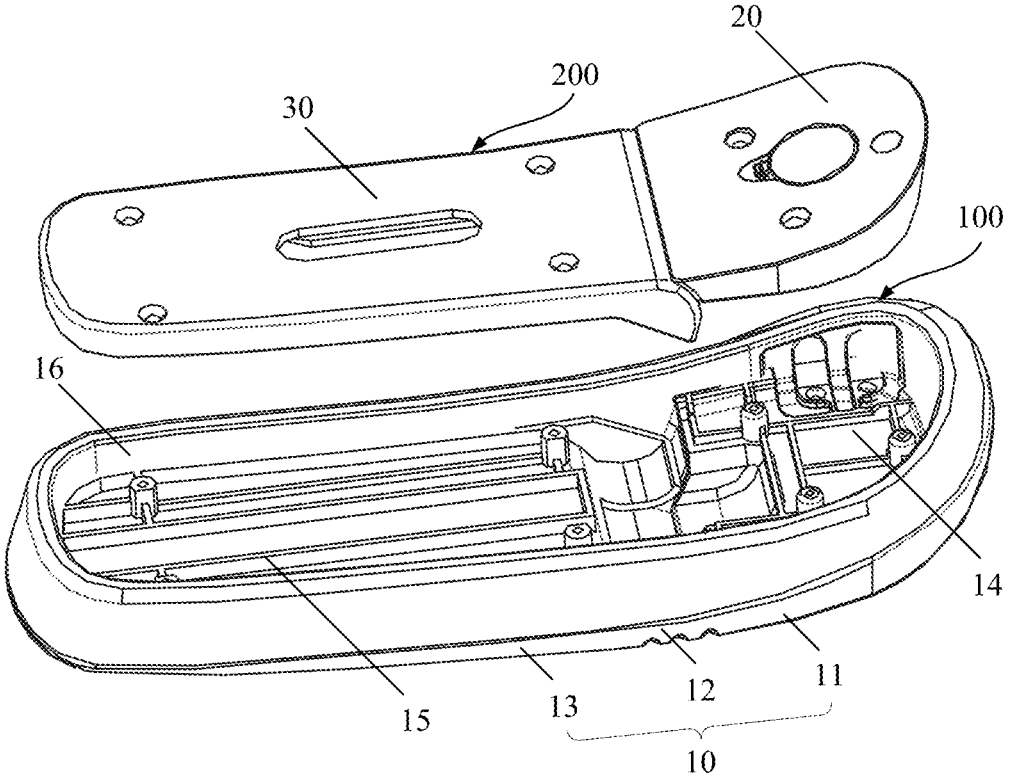
FIG. 5 illustrates another exploded view of the chair armrest according an embodiment of the present disclosure.
Figure 6:
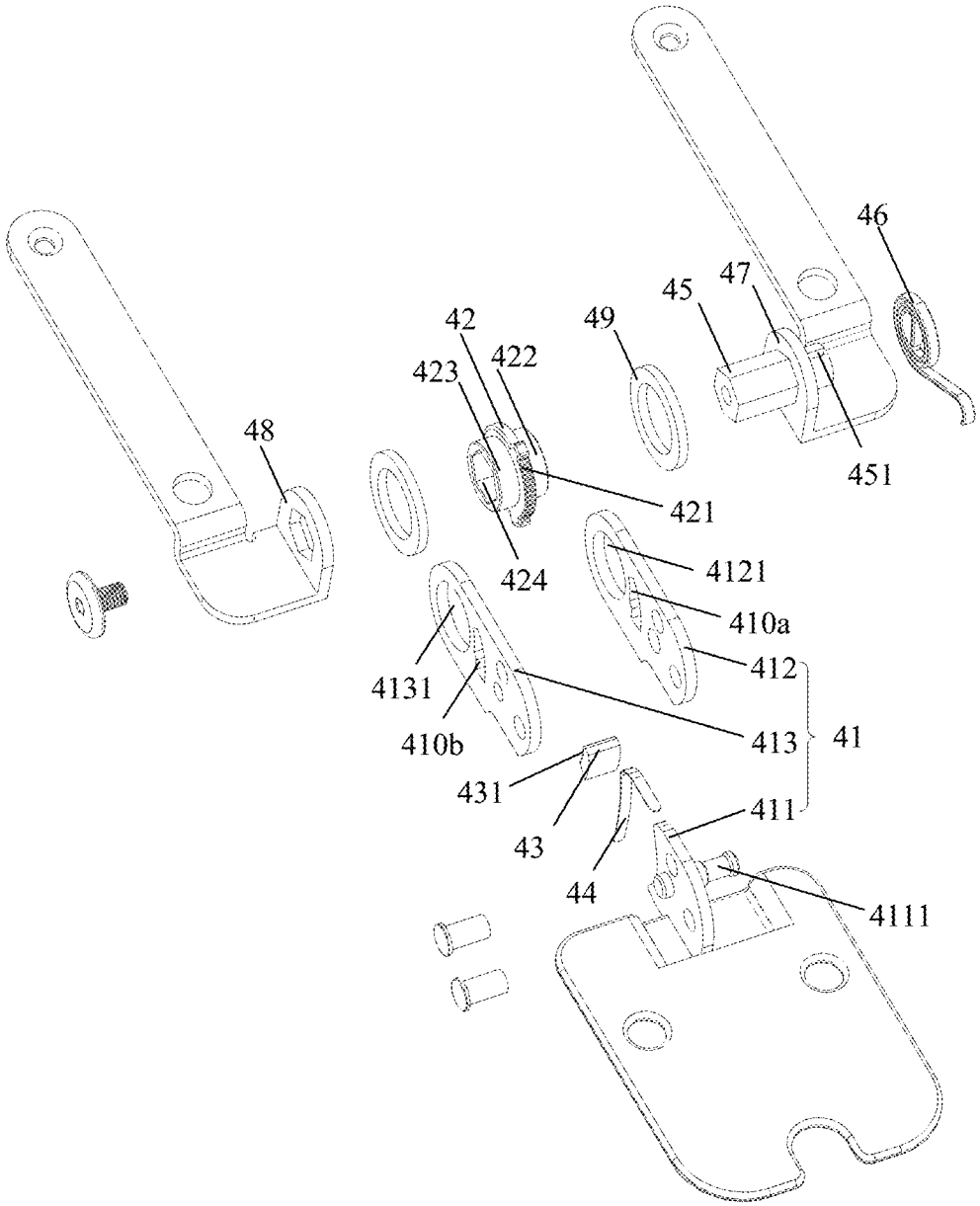
FIG. 6 illustrates an exploded view of a rotation locking structure according to an embodiment of the present disclosure.
Figure 7:
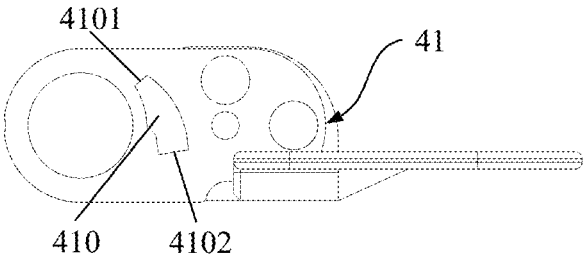
FIG. 7 illustrates a schematic view of a side structure of a guide assembly according to an embodiment of the present disclosure.

An embodiment of the present disclosure also provides a chair armrest. Referring to FIG. 4 to FIG. 7 in combination with FIG. 1 to FIG. 3. FIG. 4 illustrates an exploded view of a chair armrest according to an embodiment of the present disclosure, FIG. 5 illustrates another exploded view of the chair armrest according an embodiment of the present disclosure, FIG. 6 illustrates an exploded view of a rotation locking structure according to an embodiment of the present disclosure, and FIG. 7 illustrates a side structure of a guide assembly according to an embodiment of the present disclosure.

The chair armrest 2 includes an armrest frame 200 and the armrest pad assembly 100 in the above embodiments. For details about the specific structure and function of the armrest pad assembly 100, reference may be made to the above embodiments, which are not described herein. The armrest frame 200 includes a first support arm 20, a second support arm 30, and a rotation locking mechanism 40 connected between the first support arm 20 and the second support arm 30. The first support arm 20 is fixed to the first inner frame 14, and the second support arm 30 is fixed to the second inner frame 15. The rotation locking mechanism 40 is configured to automatically lock the first support arm 20 and the second support arm 30 in the case that the first support section 11 and the second support section 13 are relatively folded about the bendable section 12 to a predetermined position.

Since the first inner frame 14 is fixedly connected to the first support section 11 and the first support arm 20, and the second inner frame 15 is fixedly connected to the second support section 13 and the second support arm 30, in the case that the first support arm 20 rotates about a rotation axis of the rotation locking mechanism 40 relative to the second support arm 30, the first inner frame 14 and the first support section 11 are driven to be folded upward and downward about the bendable section 12 relative to the second inner frame 15 and the second support section 13, such that the relative position of the first support section 11 and the second support section 13 in space is adjusted, and the forearm and elbow of the user may be supported in sections when the user bends the elbow.

The rotation axis of the rotation locking mechanism 40 is disposed opposite to a folding axis of the first support section 11 that is bendable about the bendable section 12 relative to the second support section 13, that is, the axes are parallel to each other.

Specifically, the rotation locking mechanism 40 includes a guide assembly 41, and a fixing wheel 42, a slider 43 and an elastic member 44 that are mounted on the guide assembly 41. One end of the guide assembly 41 is fixed to the first support arm 20. The fixing wheel 42 is rotatably connected to the other end of the guide assembly 41 and fixed to the second support arm 30, and the fixing wheel 42 is provided with a plurality of fixing teeth 421 disposed along a circumferential direction. The slider 43 is provided with latching teeth 431 in mesh with the fixing teeth 421, and the slider 43 is disposed between the fixing wheel 42 and the elastic member 44. The elastic member 44 is abutted against a side, facing away from the fixing wheel 42, of the slider 43 and is in a compressed state. A guide groove 410 is disposed at a position, between the fixing wheel 42 and the elastic member 44, of the guide assembly 41. The slider 43 is partially slidably disposed in the guide groove 410, and the guide groove 410 is provided with a first end 4101 and a second end 4102. The fixing wheel 42, in response to rotating upward and downward relative to the guide assembly 41, drives the slider 43 to slide back and forth between the first end 4101 and the second end 4102, and the slider 43 and the fixing wheel 42 are meshed and in a one-way locked state in the case that the slider 43 slides to the first end 4101, and the slider 43 and the fixing wheel 42 are in an unlocked state in the case that the slider 43 slides to the second end 4102.

The first end 4101 of the guide groove 410 is a proximal end close to the rotation axis of the fixing wheel 42 relative to the guide assembly 41, and the second end 4102 is a distal end far away from the rotation axis of the fixing wheel 42 relative to the guide assembly 41.

The fixing wheel 42 is fixed to the first support arm 20, the fixing wheel 42 is rotatably connected to the guide assembly 41, and the guide assembly 41 is fixed to the second support arm 30, such that the first support arm 20 and the second support arm 30 may relatively rotate about the central axis of the fixing wheel 42 (that is, the rotation axis of the fixing wheel 42 relative to the guide assembly 41 is collinear with the rotation axis of the first support arm 20 relative to the second support arm 30), so as to adjust the relative position therebetween.

The slider 43 may be slidably disposed between the fixing wheel 42 and the elastic member 44 via the guide groove 410, and the elastic member 44 is abutted against a side, facing away from the fixing wheel 42, of the slider 43. The latching teeth 431 is disposed on a side, facing towards the fixing wheel 42, of the slider 43, such that the elastic member 44 may supply an elastic driving force for maintaining meshing between the slider 43 and the fixing wheel 42, and the latching teeth 431 of the slider 43 and the fixing teeth 421 of the fixing wheel 42 have a tendency to maintain intermeshing under the action of the elastic member 44.

The fixing wheel 42 and the slider 43 are meshed with the latching teeth 431 via the fixing teeth 421. In the case that the fixing wheel 42 rotates relative to the guide assembly 41, relative movement is present between the fixing wheel 42 and the slider 43.

During use, in the case that the first support arm 20 rotates along a direction (such as upward) about the rotation axis of the rotation locking mechanism 40, relative to the second support arm 30, the fixing wheel 42 drives the slider 43 to slide to the second end 4102, the fixing wheel 42 is not meshed with the fixing teeth 421 or the latching teeth 431 of the slider 43, such that the fixing wheel 42 and the slider 43 are in an unlocked state, and the first support arm 20 may continue to rotate along this direction relative to the second support arm 30. When hovering at a position, where the first support arm 20 needs to be rotated along a reverse direction (such as downward), the elastic member 44 drives the slider 43 to be meshed with the fixing wheel 42 under the action of the elastic force. The fixing wheel 42 drives the slider 43 to move to the first end 4101, thereby locking the first support arm 20 in the hovering position.

Where the first support arm 20 needs to be reset to a horizontal state, the first support arm 20 needs to be rotated along a direction, the slider 43 is driven to slide to the second end 4102, and then the first support arm 20 is quickly rotated along a reverse direction. In this process, since the elastic force of the elastic member 44 is insufficient to push the slider 43 to be meshed with the fixing wheel 42, such that the slider 43 may not move from the second end 4102 to the first end 4101 to lock the fixing wheel 42. Therefore, the reset operation may be achieved. In this way, the relative position of the first support arm 20 and the second support arm 30 may be adjusted by rotation along a forward direction, and the relative folding position of the first support section 11 and the second support section 13 may be adjusted. A height position of the first end 4101 on the guide assembly 41 is higher than a height position of the second end 4102 on the guide assembly 41.

In some embodiments, the guide groove 410 is an arc-shaped groove. A width of the arc-shaped groove along a radial direction progressively increases from the first end 4101 to the second end 4102. Since the slider 43 are meshed with the fixing wheel 42 under the elastic force of the elastic member 44, a smaller width of the arc-shaped groove along a radial direction causes a smaller moving space between the slider 43 and the fixing wheel 42 such that the slider 43 and the fixing wheel 42 are incapable of moving along the radial direction and thus incapable of detaching from each other. A larger width of the arc-shaped groove along the radial direction causes a larger moving space between the slider 43 and the fixing wheel 42 such that the slider 43 and the fixing wheel 42 are capable of moving along the radial direction and thus capable of detaching from each other. Therefore, the width of the arc-shaped groove along the radial direction progressively increases from the first end 4101 to the second end 4102, which ensures that the latching teeth 431 of the slider 43 are better meshed with and locked to the fixing teeth 421 of the fixing wheel 42 in the case that the slider 43 is disposed at the first end 4101; and the fixing teeth 421 of the fixing wheel 42 are easily detachable from the latching teeth 431 of the slider 43 and unlocking therebetween is achieved in the case that the slider 43 is disposed at the second end 4102. Meanwhile, the guide groove 410 is configured in an arc-shaped structure to reduce a sliding resistance against the slider 43 and to avoid the problem of jamming in the case that the slider 43 slides along the guide groove 410.

In other embodiments, the guide groove 410 may also be a strip-shaped groove.

In some specific embodiments, the guide assembly 41 includes a fixing base 411, and a first guide plate 412 and a second guide plate 413 that are symmetrically disposed on both sides of the fixing base 411. The fixing base 411 is fixedly connected to the first support arm 20. A moving space is formed between the first guide plate 412 and the second guide plate 413. One end of each of the first guide plate 412 and the second guide plate 413 is fixed to the fixing base 411, and the other end of each of the first guide plate 412 and the second guide plate 413 is provided with a first through hole 4121 and a second through hole 4131 that are coaxially disposed. The fixing wheel 42 is disposed in the accommodating space and is provided with a first convex shaft 422 and a second convex shaft 423 at both ends along the axial direction, and the first convex shaft 422 and the second convex shaft 423 are in a clearance fit.

The guide groove 410 includes a first guide groove **410*a* and a second guide groove 410*b*. The first guide groove 410*a* is disposed on the first guide plate 412 and is positioned on a side, proximal to the fixing base 411, of the first through hole 4121. The second guide groove 410*b* is disposed on the second guide plate 413 and is positioned on a side, proximal to the fixing base 411, of the second through hole 4131. The slider 43 is positioned in the moving space, and both ends of the slider 43 are respectively and movably disposed in the first guide groove 410*a* and the second guide groove 410*b*. One end of the elastic member 44 is fixed to the fixing base 411, and the other end of the elastic member 44 is positioned in the moving space and abutted against a side, facing away from the fixing wheel 42, of the slider 43**.

The first convex shaft 422 of the fixing wheel 42 is inserted into the first through hole 4121, and the second convex shaft 423 of the fixing wheel 42 is inserted into the second through hole 4131, such that the fixing wheel 42 is positioned in the moving space and is rotatably connected to the guide assembly 41. One end of the slider 43 is disposed in the first guide groove 410*a*, and the other end of the slider 43 is disposed in the second guide groove 410*b*, such that the slider 43 is rotatable about central axes of the first through hole 4121 and the second through hole 4131 (that is, the rotation axis of the fixing wheel 42 relative to the guide assembly 41) along the guide groove 410 in the moving space. Both the first guide groove 410*a* and the second guide groove 410*b* have the first end 4101 and the second end 4102. The elastic member 44 may be an L-shaped metal elastic piece. One end of the metal elastic piece may be fixed to a top of the fixing base 411, and the other end of the metal elastic piece is extended into the moving space and is abutted against a side, facing away from the fixing wheel 42, of the slider 43.

The elastic member 44 may also be in an arc shape or other shapes, as long as an elastic force for driving the slider 43 to slide to the fixing wheel 42 along the guide groove 410 is supplied.

In some specific embodiments, the rotation locking mechanism 40 further includes a fixing shaft 45. A middle portion of the fixing shaft 45 is disposed in the moving space and is sleevedly fixed to the fixing wheel 42. Two ends of the fixing shaft 45 respectively penetrate the first guide plate 412 and the second guide plate 413 and reach the outside of the moving space and are fixedly connected to the first support arm 20. That is, two ends of the fixing shaft 45 are respectively extended out of the first through hole 4121 and the second through hole 4131, and are fixedly connected to the first support arm 20.

Further, a middle position of the fixing wheel 42 is also provided with a fixing hole 424 allowing both ends of the fixing wheel 42 to penetrate, the fixing shaft 45 has a prismatic structure, and the fixing hole 424 is a prismatic hole adapted to the prismatic structure, such that the fixing wheel 42 does not rotate relative to the fixing shaft 45 after being sleeved on the fixing shaft 45. Compared with fitting by a cylindrical shaft hole, the fixing wheel 42 and the fixing shaft 45 are limited and fixed with no need of a pin or other limiting members, such that fewer components are needed, the structure is simple, and disassembling and assembling of the fixing wheel 42 and the fixing shaft 45 are convenient.

It may be understood that, in other embodiments, the fixing wheel 42 and the fixing shaft 45 may also be formed as an integral structure.

In some embodiments, the rotation locking mechanism 40 further includes a restoration torsion spring 46. The restoration torsion spring 46 is disposed on the guide assembly 41. One end of the restoration torsion spring 46 is fixedly connected to the first support arm 20, and the other end of the restoration torsion spring 46 is fixed to the second support arm 30. The restoration torsion spring 46 is configured to supply a return force for restoration of the first support arm 20 and the second support arm 30.

The connection between the restoration torsion spring 46 and the first support arm 20 is specifically illustrated in FIG. 6. A side of the fixing base 411 is provided with an abutting arm 4111, wherein the abutting arm 4111 is of a cylindrical structure. One end of the fixing shaft 45 is provided with a bayonet 451. The restoration torsion spring 46 is sleeved on the end of the fixing shaft 45 provided with the bayonet 451. One end of the restoration torsion spring 46 is clamped with the bayonet 451, and the other end of the restoration torsion spring 46 is abutted against the abutting arm 4111 of the fixing base 411.

That is, in the case that the first support arm 20 and the second support arm 30 are relatively rotated to different positions, the restoration torsion spring 46 may make the first support arm 20 and the second support arm 30 have a tendency to return to an initial state by applying a return force. As an example, it is assumed that in the initial state, the first support arm 20 and the second support arm 30 are in the same horizontal position, and the restoration torsion spring 46 is in a relaxed state, then in the case that the first support arm 20 is folded upward relative to the second support arm 30 to a predetermined position (for example, an included angle between the first support arm 20 and the second support arm 30 is 30 degrees, 45 degrees, 60 degrees, or the like), the restoration torsion spring 46 is twisted and elastically deformed. This causes the restoration torsion spring 46 to generate a return force for restoration to act on the first support arm 20 and the second support arm 30, such that the first support arm 20 and the second support arm 30 have a tendency to return to the initial state upon relative rotation.

In some embodiments, the rotation locking mechanism 40 further includes a first support 47 and a second support 48. One end of each of the first support 47 and the second support 48 is fixed to the second support arm 30. The other end of each of the first support 47 and the second support 48 is fixed to both ends of the fixing shaft 45, and at least one of the first support 47 and the second support 48 is detachably connected to the fixing shaft 45. The fixing wheel 42 is sleeved on a middle position of the fixing shaft 45.

During assembling, the fixing shaft 45 only needs to run through the first through hole 4121 of the first guide plate 412, the fixing hole 424 of the fixing wheel 42, and the second through hole 4131 of the second guide plate 413 in sequence, and then the second support 48 is fixedly connected to the fixing shaft 45, such that the first guide plate 412, the fixing wheel 42, and the second guide plate 413 may be connected. In this way, assembling is convenient.

In some embodiments, the rotation locking mechanism 40 further includes two washers 49. One of the two washers 49 is sleeved on the first convex shaft 422 and is disposed between the first support 47 and the first guide plate 412. The other of the two washers 49 is sleeved on the second convex shaft 423 and is positioned between the second support 48 and the second guide plate 413.

It should be noted that in other embodiments, the rotation locking mechanism 40 may also adopt other rotation locking mechanisms that may achieve locking at any position in the conventional chair armrests.

Figure 8:
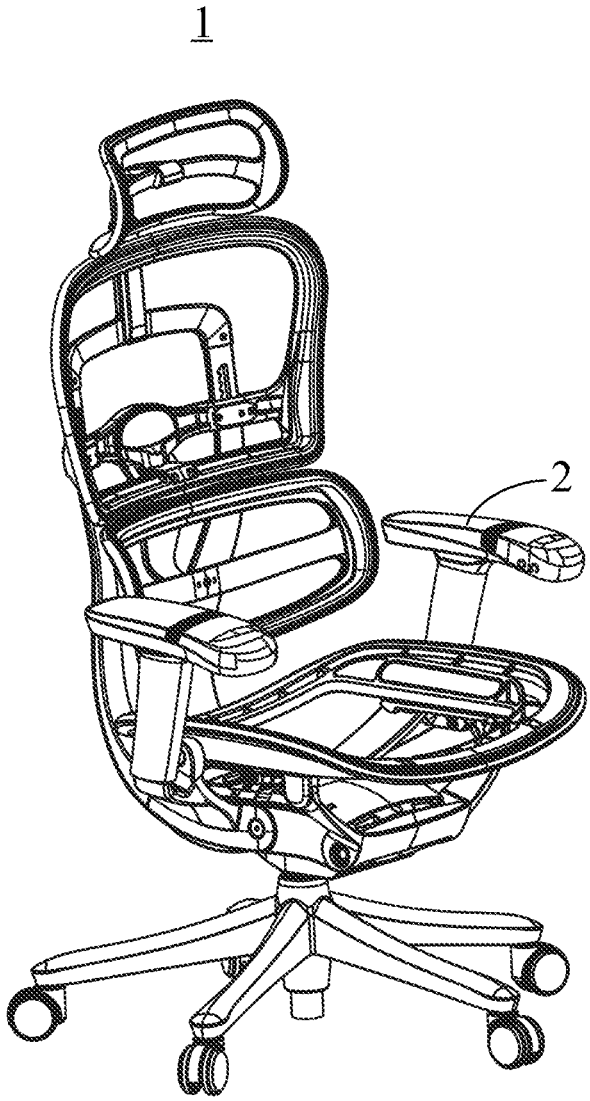
FIG. 8 illustrates a structural block view of a chair according to an embodiment of the present disclosure.

As illustrated in FIG. 8, another aspect of the present disclosure further provides a chair 1. The chair 1 includes the chair armrest 2 as described above.

It should be noted that unless otherwise specified, the technical terms and scientific terms used in the present disclosure shall express general meanings that may be understood by a person skilled in the art.

In the description of the embodiments of the present disclosure, it should be understood that the terms "central," "transversal," "longitudinal," "length," "width," "thickness," "upper," "lower," "vertical," "horizontal," "top," "bottom," "inner," "outer," "axial," "radial," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "more" or "a plurality of" signifies at least two, unless otherwise specified.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. An armrest pad assembly, comprising:

an armrest pad made of a flexible material, wherein the armrest pad comprises a first support section, a bendable section, and a second support section that are successively connected along a lengthwise direction of the armrest pad;

wherein the armrest pad is internally provided with a first inner frame and a second inner frame, the first inner frame being fixed to the first support section, and the second inner frame being fixed to the second support section;

wherein the first inner frame and the second inner frame are configured to be connected to an armrest frame of a chair, such that during upward and downward folding adjustment of the armrest frame of the chair, the first inner frame and the second inner frame drive the first support section and the second support section to be folded upward and downward about the bendable section to a predetermined position;

wherein the bendable section is provided with a recess, wherein the recess is extended to an edge of the armrest pad along a widthwise direction of the armrest pad;

wherein the recess comprises a first curved slot, a second curved slot, and a linear slot disposed between the first curved slot and the second curved slot;

wherein along the widthwise direction of the armrest pad, a distance between the first curved slot and the second curved slot progressively increases and then progressively decreases from a middle position to two ends, a spacing between the first curved slot and the second curved slot at the middle position is minimum, and the linear slot is not contiguous at the middle position.

2. The armrest pad assembly according to claim 1, wherein a plurality of recesses are provided, wherein the plurality of recesses are spaced apart along the lengthwise direction of the armrest pad.

3. The armrest pad assembly according to claim 1, wherein the recess is linear or curved.

4. The armrest pad assembly according to claim 1, wherein an accommodation chamber is disposed at a bottom of the armrest pad, wherein the recess is disposed in an inner surface, in the accommodation chamber, of the bendable section and/or disposed in an outer surface, facing away from the accommodation chamber, of the bendable section; and the first inner frame and the second inner frame are disposed in the accommodation chamber.

5. The armrest pad assembly according to claim 1, wherein the first inner frame is disposed corresponding to the first support section in the armrest pad, and the first inner frame is a support frame of the first support section; wherein the second inner frame is disposed corresponding to the second support section in the armrest pad, and the second inner frame is a support frame of the second support section.

6. The armrest pad assembly according to claim 1, wherein a thickness of the bendable section is less than or equal to a thickness of the first support section, and the thickness of the bendable section is less than or equal to a thickness of the second support section.

7. A chair armrest, comprising: an armrest frame and an armrest pad assembly;

Wherein the armrest pad assembly comprises:

an armrest pad made of a flexible material, wherein the armrest pad comprises a first support section, a bendable section, and a second support section that are successively connected along a lengthwise direction of the armrest pad;

wherein the armrest pad is internally provided with a first inner frame and a second inner frame, the first inner frame being fixed to the first support section, and the second inner frame being fixed to the second support section;

wherein the first inner frame and the second inner frame are configured to be connected to an armrest frame of a chair, such that during upward and downward folding adjustment of the armrest frame of the chair, the first inner frame and the second inner frame drive the first support section and the second support section to be folded upward and downward about the bendable section to a predetermined position;

wherein the armrest frame comprises a first support arm, a second support arm, and a rotation locking mechanism connected between the first support arm and the second support arm, the first support arm being fixed to the first inner frame, and the second support arm being fixed to the second inner frame;

wherein the rotation locking mechanism is configured to automatically lock the first support arm and the second support arm in the case that the first support section and the second support section are relatively folded about the bendable section to a predetermined position;

wherein the bendable section is provided with a recess, wherein the recess is extended to an edge of the armrest pad along a widthwise direction of the armrest pad;

wherein the recess comprises a first curved slot, a second curved slot, and a linear slot disposed between the first curved slot and the second curved slot;

wherein along the widthwise direction of the armrest pad, a distance between the first curved slot and the second curved slot progressively increases and then progressively decreases from a middle position to two ends, a spacing between the first curved slot and the second curved slot at the middle position is minimum, and the linear slot is not contiguous at the middle position.

8. The chair armrest according to claim 7, wherein the rotation locking mechanism comprises a guide assembly, and a fixing wheel, a slider and an elastic member that are mounted on the guide assembly; wherein one end of the guide assembly is fixed to the first support arm, the fixing wheel is rotatably connected to other end of the guide assembly and fixed to the second support arm, the fixing wheel is provided with a plurality of fixing teeth disposed along a circumferential direction, the slider is provided with latching teeth in mesh with the fixing teeth, the slider is disposed between the fixing wheel and the elastic member, and the elastic member is abutted against a side, facing away from the fixing wheel, of the slider and is in a compressed state;

a guide groove is disposed at a position, between the fixing wheel and the elastic member, of the guide assembly, wherein the slider is partially slidably disposed in the guide groove, and the guide groove is provided with a first end and a second end; and the fixing wheel, in response to rotating upward and downward relative to the guide assembly, drives the slider to slide back and forth between the first end and the second end, and the slider and the fixing wheel are meshed and in a one-way locked state in the case that the slider slides to the first end, and the slider and the fixing wheel are in an unlocked state in the case that the slider slides to the second end.

9. The chair armrest according to claim 8, wherein the guide groove is an arc-shaped groove, wherein a distance from the arc-shaped groove to a center of the fixing wheel progressively increases from the first end to the second end, and/or a width of the guide groove along a radial direction progressively increases from the first end to the second end.

10. The chair armrest according to claim 8, wherein the rotation locking mechanism further comprises a restoration torsion spring, wherein the restoration torsion spring is disposed on the guide assembly, one end of the restoration torsion spring is fixed to the first support arm and other end of the restoration torsion spring is fixed to the second support arm, and the restoration torsion spring is configured to supply a return force for restoration of the first support arm and the second support arm.

11. The chair armrest according to claim 8, wherein the guide assembly comprises a fixing base, and a first guide plate and a second guide plate that are symmetrically disposed on both sides of the fixing base; wherein the fixing base is fixedly connected to the first support arm; wherein a moving space is formed between the first guide plate and the second guide plate; wherein one end of each of the first guide plate and the second guide plate is fixed to the fixing base, and other end of each of the first guide plate and the second guide plate is provided with a first through hole and a second through hole that are coaxially disposed.

12. The chair armrest according to claim 8, wherein the fixing wheel is disposed in the accommodating space and is provided with a first convex shaft and a second convex shaft at both ends along the axial direction, and the first convex shaft and the second convex shaft are in a clearance fit.

13. The chair armrest according to claim 11, wherein the guide groove comprises a first guide groove and a second guide groove, wherein the first guide groove is disposed on the first guide plate and is positioned on a side, proximal to the fixing base, of the first through hole; wherein the second guide groove is disposed on the second guide plate and is positioned on a side, proximal to the fixing base, of the second through hole; wherein the slider is positioned in the moving space, and both ends of the slider are respectively and movably disposed in the first guide groove and the second guide groove; wherein one end of the elastic member is fixed to the fixing base, and the other end of the elastic member is positioned in the moving space and abutted against a side, facing away from the fixing wheel, of the slider.

14. The chair armrest according to claim 10, wherein a middle position of the fixing wheel is also provided with a fixing hole allowing both ends of the fixing wheel to penetrate, the fixing shaft has a prismatic structure, and the fixing hole is a prismatic hole adapted to the prismatic structure, such that the fixing wheel does not rotate relative to the fixing shaft after being sleeved on the fixing shaft.

15. The chair armrest according to claim 14, wherein a side of the fixing base is provided with an abutting arm, wherein the abutting arm is of a cylindrical structure; wherein one end of the fixing shaft is provided with a bayonet; wherein the restoration torsion spring is sleeved on the end of the fixing shaft provided with the bayonet; wherein one end of the restoration torsion spring is clamped with the bayonet, and the other end of the restoration torsion spring is abutted against the abutting arm of the fixing base.

16. The chair armrest according to claim 14, wherein the rotation locking mechanism further comprises a first support and a second support; wherein one end of each of the first support and the second support is fixed to the second support arm; wherein the other end of each of the first support and the second support is fixed to both ends of the fixing shaft, and at least one of the first support and the second support is detachably connected to the fixing shaft; wherein the fixing wheel is sleeved on a middle position of the fixing shaft.

17. The chair armrest according to claim 14, wherein the rotation locking mechanism further comprises two washers; wherein one of the two washers is sleeved on the first convex shaft and is disposed between the first support and the first guide plate; wherein the other of the two washers is sleeved on the second convex shaft and is positioned between the second support and the second guide plate.

18. A chair, comprising a chair armrest;

wherein the chair armrest comprises: an armrest frame and an armrest pad assembly;

wherein the armrest pad assembly comprises:

an armrest pad made of a flexible material, wherein the armrest pad comprises a first support section, a bendable section, and a second support section that are successively connected along a lengthwise direction of the armrest pad;

wherein the armrest pad is internally provided with a first inner frame and a second inner frame, the first inner frame being fixed to the first support section, and the second inner frame being fixed to the second support section;

wherein the first inner frame and the second inner frame are configured to be connected to an armrest frame of a chair, such that during upward and downward folding adjustment of the armrest frame of the chair, the first inner frame and the second inner frame drive the first support section and the second support section to be folded upward and downward about the bendable section to a predetermined position;

wherein the armrest frame comprises a first support arm, a second support arm, and a rotation locking mechanism connected between the first support arm and the second support arm, the first support arm being fixed to the first inner frame, and the second support arm being fixed to the second inner frame;

wherein the rotation locking mechanism is configured to automatically lock the first support arm and the second support arm in the case that the first support section and the second support section are relatively folded about the bendable region to a predetermined position;

wherein the bendable section is provided with a recess, wherein the recess is extended to an edge of the armrest pad along a widthwise direction of the armrest pad;

wherein the recess comprises a first curved slot, a second curved slot, and a linear slot disposed between the first curved slot and the second curved slot;

wherein along the widthwise direction of the armrest pad, a distance between the first curved slot and the second curved slot progressively increases and then progressively decreases from a middle position to two ends, a spacing between the first curved slot and the second curved slot at the middle position is minimum, and the linear slot is not contiguous at the middle position.

* * * * *